US010456644B2

(12) United States Patent
OMeara et al.

(10) Patent No.: US 10,456,644 B2
(45) Date of Patent: Oct. 29, 2019

(54) BASKETBALL NET COVER

(71) Applicants: James OMeara, Fairfield, CT (US); John Galasso, Centerport, NY (US)

(72) Inventors: James OMeara, Fairfield, CT (US); John Galasso, Centerport, NY (US)

( * ) Notice: Subject to any disclaimer, the term of this patent is extended or adjusted under 35 U.S.C. 154(b) by 0 days.

(21) Appl. No.: 16/247,606

(22) Filed: Jan. 15, 2019

(65) Prior Publication Data

US 2019/0217172 A1 Jul. 18, 2019

Related U.S. Application Data

(60) Provisional application No. 62/618,690, filed on Jan. 18, 2018.

(51) Int. Cl.

| | |
|---|---|
| ***A63B 63/00*** | (2006.01) |
| ***A63B 63/08*** | (2006.01) |
| *G09F 23/00* | (2006.01) |
| *A63B 69/00* | (2006.01) |

(52) U.S. Cl.

CPC ..... *A63B 63/083* (2013.01); *A63B 69/0071* (2013.01); *G09F 23/0066* (2013.01)

(58) Field of Classification Search

CPC ..... A63B 63/083; A63B 69/0071; A63B 2063/086

USPC ..... 473/485, 447, 448

See application file for complete search history.

(56) References Cited

U.S. PATENT DOCUMENTS

| | | | | | |
|---|---|---|---|---|---|
| 1,520,196 | A * | 12/1924 | Medart | A63B 63/083 | 248/315 |
| 4,877,241 | A * | 10/1989 | Rothbard | A63B 63/083 | 473/485 |
| 4,991,837 | A * | 2/1991 | Deal | A63B 63/083 | 473/485 |
| D325,947 | S * | 5/1992 | Cass | D21/704 | |
| 5,156,394 | A * | 10/1992 | Deal | A63B 63/083 | 473/485 |
| 5,301,939 | A * | 4/1994 | Ellsworth | A63B 63/083 | 473/485 |
| D354,534 | S * | 1/1995 | Michalik | D21/703 | |
| 5,735,760 | A * | 4/1998 | Brewer | A63B 63/083 | 473/485 |
| 6,174,249 | B1 * | 1/2001 | Mattoon | A63B 63/083 | 473/485 |
| 6,746,349 | B2 * | 6/2004 | Neiberger | A63B 63/083 | 473/485 |
| 7,390,274 | B2 * | 6/2008 | Bradford | A63B 63/083 | 473/485 |
| D590,899 | S * | 4/2009 | King | D21/705 | |
| 7,553,245 | B2 * | 6/2009 | Dones | A63B 63/083 | 473/447 |
| D697,149 | S * | 1/2014 | Heck | D21/701 | |
| 9,468,826 | B2 * | 10/2016 | Smith | A63B 63/083 | |

(Continued)

*Primary Examiner* — Mark S Graham

(74) *Attorney, Agent, or Firm* — Andrew Morabito

(57) ABSTRACT

A basketball net cover comprising; a sheet of fabric having a first end, a second end, a first edge, and a second edge, wherein the first end corresponding to a first radius and the second end corresponding to a second radius, at the first end a plurality of openings are positioned a predetermined distance from one another and are of a predetermined length, wherein the first edge and the second edge are secured together a frustum of a cone is formed wherein the top edge has a first circumference and the bottom edge has a second circumference.

19 Claims, 3 Drawing Sheets

(56) References Cited

U.S. PATENT DOCUMENTS

| | | | | |
|---|---|---|---|---|
| 2004/0038760 | A1* | 2/2004 | Diaz | A47G 29/06 473/485 |
| 2004/0152543 | A1* | 8/2004 | Kershaw | A63B 63/083 473/485 |
| 2009/0233738 | A1* | 9/2009 | Yu | A63B 24/0021 473/485 |
| 2010/0190588 | A1* | 7/2010 | Yu | A63B 63/083 473/485 |
| 2014/0057744 | A1* | 2/2014 | Whitten | A63B 63/083 473/485 |

* cited by examiner

BASKETBALL NET COVER

CROSS-REFERENCE TO RELATED APPLICATIONS

This application is a continuation-in-part (and claims the benefit of priority under 35 USC 120) of U.S. application No. 62/618,690 filed Jan. 18, 2018. The disclosure of the prior applications is considered part of (and is incorporated by reference in) the disclosure of this application.

BACKGROUND OF THE INVENTION

Basketball is a common sport among youths and adults, alike. A basketball hoop is typically provided with a net. The net is typically constructed as a very wide mesh formed by cords tied at some regular spacing.

A typical basketball net may use a nylon cord of approximately ¼-inch diameter. Typical cords are comprised of a bundle of individual strands enclosed within a braided sheath. Once the braided sheath has become damaged by tearing, abrasion, accidental ripping, or the like, the individual strands within the cord quickly become destroyed as well.

Basketball nets are sometimes placed outdoors. Sun and weather may take their toll on a basketball net which is not quick to dry. That is, a diameter of approximately ¼ inch means that the central fibers of the cord in the net are ⅛ inch from a surface. Thinner materials would dry more quickly. Thus, water would not be left in a net for a long period of time, if the net could be dried faster.

One principal cause of damage in basketball nets is rough play by users. For example, it is not uncommon for youngsters to grab the mesh of a net, or to hang from the net. Since a net is only supported at certain discrete locations, substantial strain and stress may be applied at those support points.

Likewise, such a combination of cords threaded over the thin hooks of a basketball hoop, and knots tied at periodic junctions in the net, produce stress concentrations in the cords and fibers of the net. A knotted, kinked, tightly constricted, or otherwise restricted cord may have a local stress concentration that effectively multiplies the load applied by a user hanging from a net. The result is that a net may be damaged more than is apparent.

A typical basketball net is a rather generic, nondescript item. Personalizing articles of clothing, particularly sportswear and athletic gear, with an individual's name, with the name of a school, or with the name of a commercial team, has long been recognized as a powerful marketing device. Owing to the nature of its construction, a typical basketball net is not adapted to receive a logo, marking, image, or the like. Whether a team is a high school team, a national franchise, or a local city league, its logo may have meaning to some population. Thus, the desirability of placing some form of logo or name on a basketball net may be very significant.

A meaningful image requires sufficient surface area to receive the image. Thus, although an image may have gaps, or be formed in a mosaic-type of structure, surface may visually predominate over intermediate voids or be sufficient for forming an aesthetically pleasing image.

It is desired to have a basketball net with detachable portions to allow for increased visibility of advertising or team logos, as well as a device which assists in directing the flight course of the ball.

SUMMARY

The present invention relates to a basketball net cover comprising; a sheet of fabric having a first end, a second end, a first edge, and a second edge, wherein the first end corresponding to a first radius and the second end corresponding to a second radius, at the first end a plurality of openings are positioned a predetermined distance from one another and are of a predetermined length, wherein the first edge and the second edge are secured together a frustum of a cone is formed wherein the top edge has a first circumference and the bottom edge has a second circumference.

In a second embodiment, the present inventions relates to a method of making a basketball net cover comprising; providing a sheet of fabric having a first end, a second end, a first edge, and a second edge, forming a net cover, wherein the sheet of fabric is shaped as a frustum, wherein the first end corresponding to a first radius and the second end corresponding to a second radius, wherein the first edge and the second edge are secured together a frustum of a cone is formed wherein the top edge has a first circumference and the bottom edge has a second circumference, creating a plurality of openings in the formed net cover distal to the first end, wherein the plurality of openings are created at predetermined locations along the first end, connecting the net cover to a net, wherein the net passes through each of the plurality of openings, and connecting the net with the net cover to a hoop.

DETAILED DESCRIPTION OF THE INVENTION

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

Figure 1:
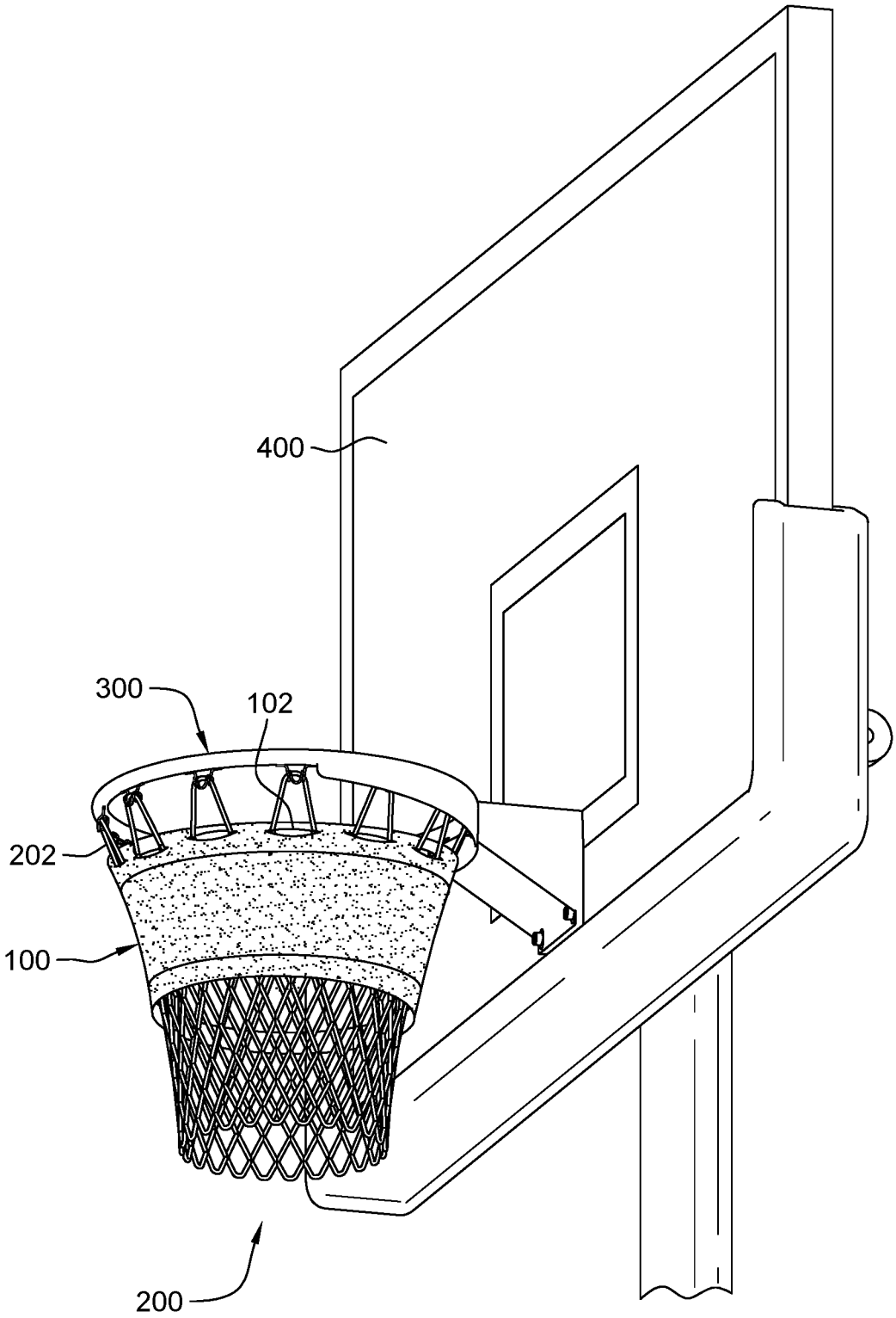
FIG. 1 depicts a perspective view of a backboard, with a basketball net attached, and a cover attached to a net, in accordance with one embodiment of the present invention.
Figure 2:
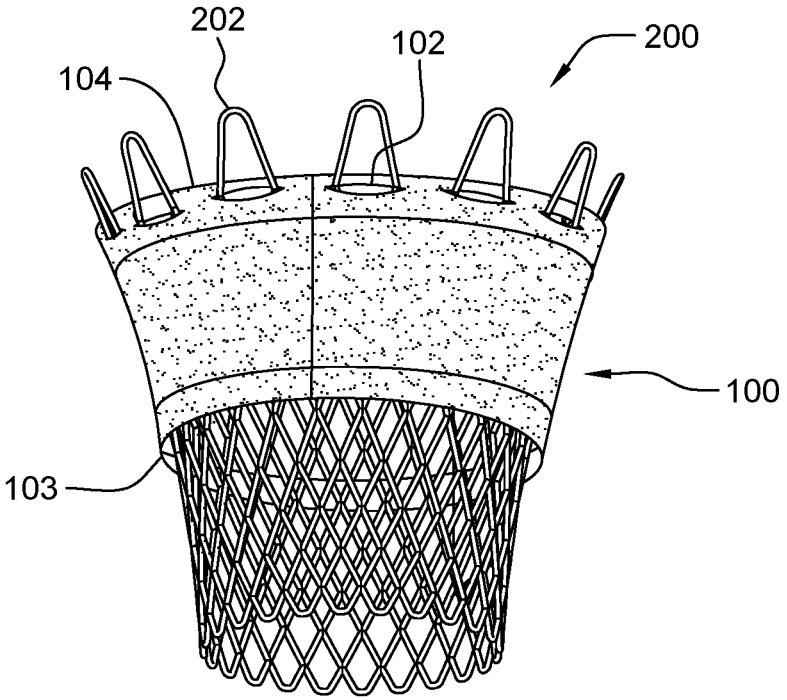
FIG. 2 depicts a front view of the basketball net and the cover, in accordance with one embodiment of the present invention.
Figure 3:
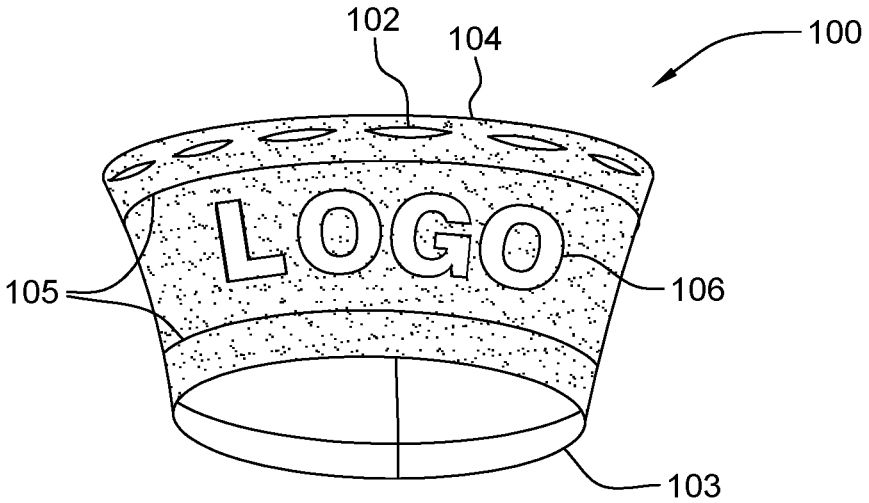
FIG. 3 depicts a front view of the cover, in accordance with one embodiment of the present invention.
Figure 4:
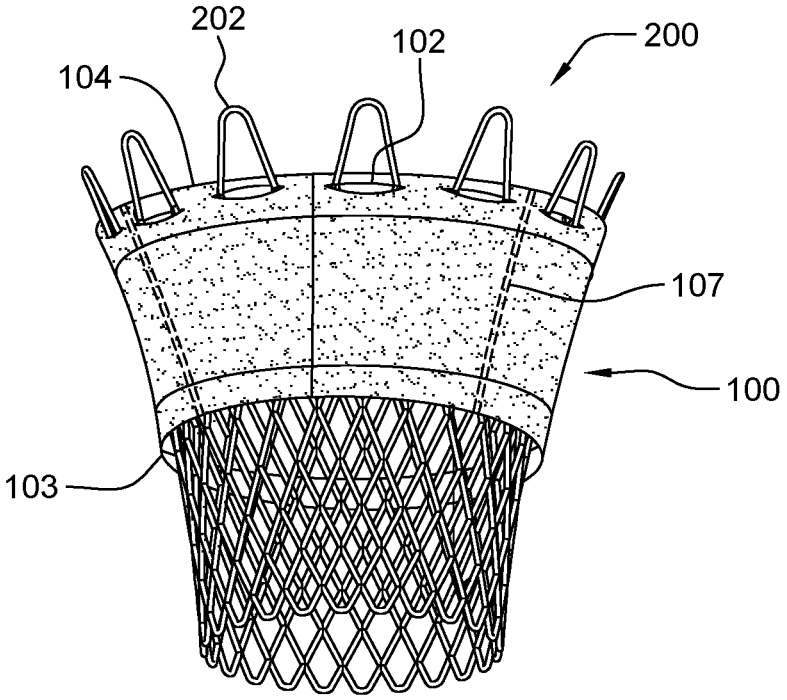
FIG. 4 depicts a front view of the basketball net and the cover, in accordance with one embodiment of the present invention.

Referring now to FIGS. 1-4, a net cover 100 is attached to a conventional basketball net 200, which is attached to a conventional basketball rim 300. The basketball rim 300 is attached to a conventional basketball backboard 400. The basketball net 200, rim 300, and backboard 400 can be any configuration known in the art including but not limited to outdoor basketball backboard assemblies, indoor basketball backboard assemblies and miniature basketball backboard assemblies. The net 200, rim 300, and backboard 400, are made of materials known in the art. The net 200 may be made from a suitable flexible and durable material. The rim 300 may be made from a high strength metal, and the backboard 400 may be made from a high strength glass or plastic material. The net cover 100 provides a cover which both assists in the redirection of the ball upon entering the net as well as providing a decorative cover for the typical basketball net 200.

In the depicted embodiment, the net cover 100 is secured to the net 200 through the loops 202 of the net 200 which are attached to the rim 300. The net cover 100 has a plurality of slots 102 which allow the passage of the loops 202 to pass through the net cover 100. The plurality of slots 102 are positioned to coincide with the loops 202 of the net 200. This assists in the orientation of the net cover 100, and also assists the net cover 100 to have minimal affect on the net 200. In the depicted embodiment, the lower end 103 of the net cover 100 does not come in contact with the net 200. In some embodiments, the lower end 103 of the net cover is attached to the net 200. In some embodiments, the net cover 100 is secured to the net 200 only at top end of the net 200 near the rim 300. Each of the slots 102 are sized substantially the same, so that when the loops 202 pass through the slots 102, the net cover 100 is substantially level across the top edge 104. In one embodiment, the slots 102 width is one inch. In additional embodiments, the slots 102 are a different length depending upon the intended position of the net cover 100 relative to the net 200. For example, if the net cover 100 is preferred to sit higher on the net 200, the slots 102 are a shorter length.

The net cover 100 is made from a durable yet flexible material and have a plurality of small openings substantially distributed symmetrically across the entirety of the net cover 100. This provides a semi-transparent cover of the net 200 while also providing a larger surface to display various colors, words, logos, images, or the like which could be printed on the type of material used to create the net cover 100. In the depicted embodiment, a logo 106 is positioned across the surface of the net cover 100. In various embodiment, the logo 106 may be placed in various positions to allow for viewing in a 360-degree environment. In some embodiments, the net cover 100 is made from a plurality of materials and may have different layers or rings of materials in its construction. The net cover 100 may be made from flexible, durable materials that are easily cleaned, such as plastic, acetate, nylon, cotton fabric, and cotton-polyester blend fabric. In some embodiments, the net cover 100 has a plurality of structural supports 107 integrated into the net cover. The structural supports 107 may be various rigid pieces that are secured to the net cover 100. This may be metal or rigid plastics which are preformed to contour to the shape of the net cover 100. In some embodiments, the structural support 107 may provide support for the net cover 100 to maintain a proper shape of the net cover 100 but may be moveable when interacting with a ball. The structural supports 107 may be used to keep the net cover 100 in a set position to reduce its interaction with the net 200. In other embodiments, the structural supports 107 may be integrated into the net cover 100 to assist with affecting the trajectory of the ball as it passes through the net 200. In some embodiments, this structural support is integrated into the hem 105 of the net cover 100. In other embodiments, the structural support extends from the top edge 104 to the bottom edge 103.

The length of the net cover 100 is dependent upon the desired imagery to be displayed so that it is visible from a predetermined distance. In the depicted embodiment, the net cover 100 covers the upper portion of the net 200. The length of the net cover 100 is designed to substantially follow the contour of the net 200 so as to not interfere with players reaching upwards towards the rim 300.

The top edge 104 of the net cover 100 has a circumference larger than but similar to that of the top rung of the net 200. This allows the net cover 100 to have little effect on the openings and tension of the net 200. The bottom edge 103 has a second circumference. In some embodiments, the second circumference is less than that of the top edge circumference, but greater than the circumference of the bottom end of the net 200. In some embodiments, vertical supports are positioned from the top edge 104 to the bottom edge 103 to increase the rigidity of the net cover 100. In some embodiments, the net cover 100 has a linear exterior surface relative to the top edge 104 and the bottom edge 103. In additional embodiments, the net cover 100 may have a curved or contoured exterior surface to substantially mimic that of the net 200.

In some embodiments, the top edge 104 and/or the bottom edge 103 may be hemmed 105. The hemmed design assists in improving the strength of the top edge 104, as well as improving the aesthetics of the net cover 100. Dependent upon the length of the overlap of the hemmed region, two slots 102 cut into the net cover 100 in predetermined locations, so that when the top or bottom edge is folded over and hemmed, the slots 102 substantially line up. In some embodiments, the top or bottom edge is hemmed and then the slot openings are cut through the double layered fabric to allow for passage of the net 200. In the depicted embodiment, both the top edge 104 and the bottom edge 103 are hemmed.

The net cover 100 in some instances may assist in directing the trajectory of the ball through the net 200. In some embodiments, the net cover 100 is designed to create minimal resistance with the ball once it passes below the rim 300 and comes in contact with the net 200. In other embodiments, the net cover 100 is designed to affect the trajectory of the ball once it comes in contact with the net 200, by reducing the amount of displacement or stretching of the net 200 by the force of the ball, and thereby assisting in directing the ball to exit the net 200 substantially directly down a center axis of the net 200. This is beneficial when the invention is used in a public area or by a road so that the ball does exit the net and travel into the street and potentially harm someone. The ball would preferably exit the net 200 straight down to the ground below the net 200. In some embodiments, wherein the structural supports 107 are integrated into the net to assist in directing the ball substantially perpendicular to the backboard 400, and back to the player.

Due to the net cover's 100 different physical properties from the net 200, the ball may interact differently with the net cover 100. The flexibility of the net cover 100 may be less than that of the net 200. In additional embodiments, the net cover 100 may be reinforced with additional material to increase the strength and decrease the flexibility of the net cover 100. Such as slow the movement of the ball. This may be beneficial to allow for easier retrieval of the ball once a basket has been made. This increases the safety of the game because if a ball at a high-speed pass through the hoop 300, the net 200 is unlikely to slow or redirect the ball sufficiently enough. The net cover 100 further assists with direction of the ball and reducing the speed at which the ball travels. This increases the safety of the game because the players, will anticipate where the ball will go after a basket is made regardless of the angle, speed, or direction of the shot.

In the depicted embodiment, the net cover 100 is comprised of a single piece of material, wherein the slots 102 are cut through the material at the predetermined location, predetermined number, and predetermined width. In embodiments, where the hem 105 is incorporated into the design, slots 102 are cut a predetermined distance from the top of the material, the material is folded, so that the slots 102 align distal to the newly formed top edge 104 is folded over so that the slots 102 align, and the folded section is secured to the net cover 100. In the depicted embodiment, the bottom edge 103 is also folded and secured to improve the longevity of the net cover 100. In additional embodiments, portions of the net cover 100 may have additional fabric, material, coatings, or reinforcement to increase the longevity of the net cover 100 where it is likely to come in contact with the basketball or other object. For example, along the interior surface of the net cover 100 which is closed to the backboard 400, there may be an additional piece of material that has a greater strength than the net cover 100.

In additional embodiments, the net cover 100 may be comprised of a plurality of different pieces of fabric or material.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A basketball net assembly comprising:

a basketball net;

a sheet of fabric attached to the basketball net, having a top end, a bottom end, a first edge, and a second edge, wherein the top end corresponding to a first radius and the bottom end corresponding to a second radius, at the top end a plurality of openings are positioned a predetermined distance from one another and are of a predetermined length, wherein when the first edge and the second edge are secured together a frustum of a cone is formed when the top edge has a first circumference and the bottom edge has a second circumference.

2. The basketball net cover of claim 1, wherein the first circumference is that which is substantially similar to that of a basketball rim.

3. The basketball net cover of claim 1, wherein the second circumference is less than the first circumference, but larger than that of the circumference of the lower end of a basketball net.

4. The basketball net cover of claim 1, further comprising an image imprinted on the sheet of fabric.

5. The basketball net cover of claim 1, further comprising a hem along the top end, wherein a top edge formed, and the plurality of openings are positioned distal to the top edge.

6. The basketball net cover of claim 1, wherein the sheet of fabric is comprised of multiple pieces of fabric.

7. The basketball net cover of claim 6, wherein the multiple pieces of fabric are of different materials.

8. The basketball net cover of claim 1, wherein the sheet of fabric is made from a knitted material, wherein the knitted material has a predetermined elasticity property.

9. The basketball net cover of claim 1, wherein the sheet of fabric has a plurality of small openings substantially distributed symmetrically across the entirety of the sheet of fabric, wherein the sheet of fabric is semi-transparent.

10. The basketball net cover of claim 1, further comprising at least one structural support integrated with the sheet of fabric.

11. The basketball net cover of claim 10, wherein at least one structural support is made from a rigid material.

12. The basketball net cover of claim 11, wherein the at least one structural support extends from the top edge to the bottom edge.

13. The basketball net cover of claim 11, wherein the at last one structure support extends around at least the circumference of the top end of the net cover.

14. A method of making a basketball net cover comprising:

providing a sheet of fabric having a top end, a bottom end, a first edge, and a second edge;

forming a net cover, wherein the sheet of fabric is shaped as a frustum, wherein the top end corresponds to a first radius and the bottom end corresponds to a second radius, wherein when the first edge and the second edge are secured together a frustum of a cone is formed wherein the top edge has a first circumference and the bottom edge has a second circumference;

creating a plurality of openings in the formed net cover distal to the top end, wherein the plurality of openings are created at predetermined locations along the top end;

connecting the net cover to a net, wherein the net passes through each of the plurality of openings; and connecting the net with the net cover to a hoop.

15. The method of making a basketball net cover of claim 14, further comprising, integrating a plurality of structural supports into the formed net cover extending from the top end to the bottom end at predetermined positions along the first circumference.

16. The method of making a basketball net cover of claim 15, further comprising, integrating a plurality of structural supports into the formed net cover distal to at least one of the top edge and the bottom edge.

17. The method of making a basketball net cover of claim 15, wherein, a plurality of sections of fabric are connected to form the sheet of fabric.

18. The method of making a basketball net cover of claim 15, further comprising, attaching at least one image on an exterior surface of the net cover.

19. A basketball net cover comprising:

a sheet of fabric, having a top end, a bottom end, a first edge, and a second edge, wherein the top end corresponding to a first radius and the bottom end corresponding to a second radius, at the top end a plurality of openings are positioned a predetermined distance from one another and are of a predetermined length, wherein when the first edge and the second edge are secured together a frustum of a cone is formed wherein the top end has a first circumference and the bottom end has a second circumference, and at least one structural support extends from the top end to the bottom end.

* * * * *